US007578151B2

(12) United States Patent
Blomberg et al.

(10) Patent No.: US 7,578,151 B2
(45) Date of Patent: Aug. 25, 2009

(54) WASHING FLUID TUB FOR A WASHING MACHINE

(75) Inventors: Barbara Blomberg, Guetersloh (DE); Egon Brockschmidt, Guetersloh (DE); Matthias Hollenhorst, Lippstadt (DE); Thorsten Kuka, Guetersloh (DE)

(73) Assignee: Miele & Cie. KG., Guetersloh (DE)

( * ) Notice: Subject to any disclaimer, the term of this patent is extended or adjusted under 35 U.S.C. 154(b) by 655 days.

(21) Appl. No.: 11/243,049

(22) Filed: Oct. 4, 2005

(65) Prior Publication Data

US 2008/0060389 A1 Mar. 13, 2008

(30) Foreign Application Priority Data

Oct. 4, 2004 (DE) ..... 10 2004 048 556

(51) Int. Cl.
*D06F 37/26* (2006.01)

(52) U.S. Cl. ..... 68/142

(58) Field of Classification Search ..... 68/142; 134/184, 198

See application file for complete search history.

(56) References Cited

U.S. PATENT DOCUMENTS 3,333,282 A * 8/1967 Mustee ..... 4/640
4,423,607 A * 1/1984 Munini ..... 68/23.2
5,115,651 A * 5/1992 Nukaga et al. ..... 68/17 R
5,965,236 A * 10/1999 Durazzani ..... 428/156
6,279,357 B1 * 8/2001 Didlick et al. ..... 68/20
6,530,245 B1 * 3/2003 Kawabata et al. ..... 68/20
2004/0148979 A1 8/2004 No et al.

FOREIGN PATENT DOCUMENTS

| | | | |
|---|---|---|---|
| DE | 6752636 | | 3/1969 |
| DE | 199 60 501 | A1 | 6/2001 |
| GB | 2272913 | A | 6/1994 |
| JP | 54-88668 | | 7/1979 |
| JP | 58-261 | | 1/1983 |
| JP | 4-189397 | | 11/1990 |
| JP | 02305596 | | 12/1990 |
| JP | 07-068086 | * | 3/1995 |

OTHER PUBLICATIONS

European Patent Office 1 538 252 Jun. 2003.*

* cited by examiner

*Primary Examiner*—Frankie L Stinson
(74) *Attorney, Agent, or Firm*—Darby & Darby

(57) ABSTRACT

A washing fluid tub of a washing machine for accommodating a rotatably driven laundry drum and provided with electrical components in its vicinity, the tub being provided at its outer surface with a plurality of rib structures for diverting any leaking water from the electrical components, at least some of the rib structures being provided with V-shaped drip-off sites for controlling the direction of flow of the water.

12 Claims, 5 Drawing Sheets

WASHING FLUID TUB FOR A WASHING MACHINE

BACKGROUND OF THE INVENTION

1. Filed of the Invention

The invention, in general, relates to a novel tub for washing fluid and, more particularly to a tub of the kind referred to for rotatably accommodating a washing machine drum and provided at its exterior wall with rib structures.

2. The Prior Art

A washing fluid tubs made of non-metallic materials for washing machines is well known in the art. The tub is made of a synthetic material and is mounted as a molded part in the interior of a washing machine. The structure of the tub is such as to accommodate components or aggregates cooperating with the tub thereon. The tub is characterized by an opening in its axis of rotation for receiving the drive shaft of the rotatable drum disposed in the tub. Moreover, brackets may be arranged below the tub for receiving a drive motor, for instance connected to the drum by a fan belt or the like. The tub is also provided with at least one connecting pipe for feeding and removing the washing fluid.

In order to impart to the rear wall of the tub the rigidity or strength required rotatably to support the drum thereon, the tub, as disclosed, for instance, by German patent specification DE 199 60 501 A1, is provided with rib structures which lend stiffness or structural strength to the rear area of the tub in particular. Such a washing fluid tub, in a washing machine which is loaded through the sidewall of the drum, is mounted within the housing of the machine with the loading opening being disposed at the upper side of the cylindrical wall. Since in such an arrangement requires opening of the tub for placing laundry into the drum, it is possible that when loading wet laundry or adding water through the opening water may drip or swill between housing and the outer wall of the tub. However, for reasons of electrical safety, it is absolutely necessary that neither water nor humidity reach the electrical components mounted within the machine.

In a front-loading washing machine the loading opening is disposed in the front wall of the washing fluid tub and the opening is sealed with respect to the housing of the machine by a folding bellows seal. In a normal operation it may be assumed that the tub in the housing is protected from water leakage. However, with a leaking feed hose above the tub it is nevertheless possible in a front-loading washing machine that water leaks to the outer surface, particularly in the area of its cylindrical surface, of the washing fluid tub. Here, too, it is absolutely necessary that neither water nor humidity reach any electrical components.

While according to the state of the art the integral rib structures are capable of preventing this, they nevertheless leave room for improvement. A further known possibility is to protect electrical components from penetrating water and humidity by housings, covers or encapsulations. Such measures would, however, not only be relatively complex and, therefore, expensive, but they would also impede heat dissipation. Another known construction proposes an elastic folding bellows between the loading opening of the washing fluid tub and the opening of the housing for preventing the penetration of water in this area. However, since the loading opening is of rectangular configuration a lasting and reliable seal between the surrounding margin of the loading opening and the housing cover cannot be ensured because of possible leakage of the folding bellows.

JP 02305596 A of "Patent Abstracts of Japan" discloses a tub washing machine having a vertical rotational axis. In this case, the drive motor is arranged beneath the bottom of the tub. To prevent condensation water from running along the wall of the tub to the bottom of the tub and in this area from dripping onto the motor, an outwardly directed collar-shaped rib is arranged on the wall of the tub. However, the rib acts rather like a cover in the vicinity of the motor. Water sprays and splashes may easily get below this cover and drip onto the motor. Another disadvantage is that water dripping off the cover precipitates and splashes on the bottom of the housing immediately adjacent the motor.

OBJECTS OF THE INVENTION

It is therefore a primary object of the invention to provide a washing fluid tub capable of withstanding problems caused by leaking or splashing water.

Another object of the invention is to provide a washing fluid tub provided with means for diverting undesired water from critical areas of the washing machine.

Other object will in part be obvious and will in part appear hereinafter.

SUMMARY OF THE INVENTION

In the accomplishment of these and other objects, the invention, in a preferred embodiment thereof, provides a washing fluid tub having at its exterior wall integrally formed stiffening rib structures and, adjacent thereto, water deflection ribs for protecting aggregates cooperating with the tub from leaking water and humidity and for collecting and diverting water, and in the upper area of its external wall a plurality of ribs affecting an advance channeling of water and humidity.

Advantageously, further ribs are surrounding the lower area of the external wall for catching the water in a controlled manner and for diverting it. The surrounding rib is provided with defined drip-off sites for diverting the water from exactly defined sites so that it will be either directly or indirectly guided to areas where it cannot cause any damage. In this manner it is possible to prevent water from flowing over the deflection rib to critical areas, for instance those, where electrical components are present.

An advance channeling of water running along the outside of the tub ensures early on that water is kept away from critical areas. In accordance with the invention water is caused to drip off exactly defined sites. In case a deflection rib is flowed over by a wave of water, it is deflected by an additional rib at sites, for instance over the drive motor. The major purpose of the advance channeling is to keep water away from areas where it could drip off from a large height and thus splash directly or indirectly to critical areas. Moreover, larger quantities of water are divided to prevent subsequent spilling from water diverting ribs. The advance channeling ribs are pointed at their lower end sections. Accordingly, water running along the outer edge of the rib is returned to the washing fluid tub. The surrounding rib then serves to keep advance channeled water running long the outside of the washing fluid tub away from the lower range of the tub where the motor is mounted and to direct it to defined drip-off sites. The drip-off sites are selected such that water can neither directly or indirectly reach electrical contact areas. In case water is returned to the washing fluid tub because of overflow from a water diverting rib or undefined dripping or flowing off, a third redundant stage is provided. Remaining water which has not been detained by prior means is diverted in a defined manner by the pointedly converging ribs.

All brackets, tabs, etc. mounted at the lower range are provided with points from which water may drip off. The angles of the points are selected such that water running along the extended edge cannot flow to critical areas.

The defined drip-off sites are advantageously characterized by being of V-shaped configuration. In this connection, a first embodiment provides for a drip-off nose below a V-shaped drip-off site for ensuring a defined dripping-off of water without allowing it to flow back in the direction of the tub.

In another embodiment the V-shaped ribs converge, or are formed such, that they impart a defined direction of flow to the water. There may be provided a forward directed recess in the tip of the V-shape with a downwardly pointing lug being provided on one of the two ribs. Water thus initially moved to the lowest point of the V-shape, with the water, because of the recess, assuming a direction of flow along the downwardly pointed lug and parallel to the wall of the tub at some distance therefrom. In a practical embodiment the lower edge of the lug is of a large radius so that the water no longer drips vertically downwardly but, because of forces of adhesion, is diverted laterally.

In accordance with a particularly advantageous embodiment of a defined drip-off site a notch open in a forward direction is provided at the top of ribs converging in a V-shaped configuration which also results in a defined flow direction. Advantageously, the notch may be provided in a lug provided below the line of intersection of the ribs.

DETAILED DESCRIPTION OF THE SEVERAL DRAWINGS

The novel features which are considered to be characteristic of the invention are set forth with particularity in the appended claims. The invention itself, however, in respect of its structure, construction and lay-out as well as its manufacturing techniques, together with other advantages and objects thereof, will be best understood from the following description of preferred embodiments when read in connection with the appended drawings, in which:

DETAILED DESCRIPTION OF THE PREFERRED EMBODIMENTS

Figure 7:
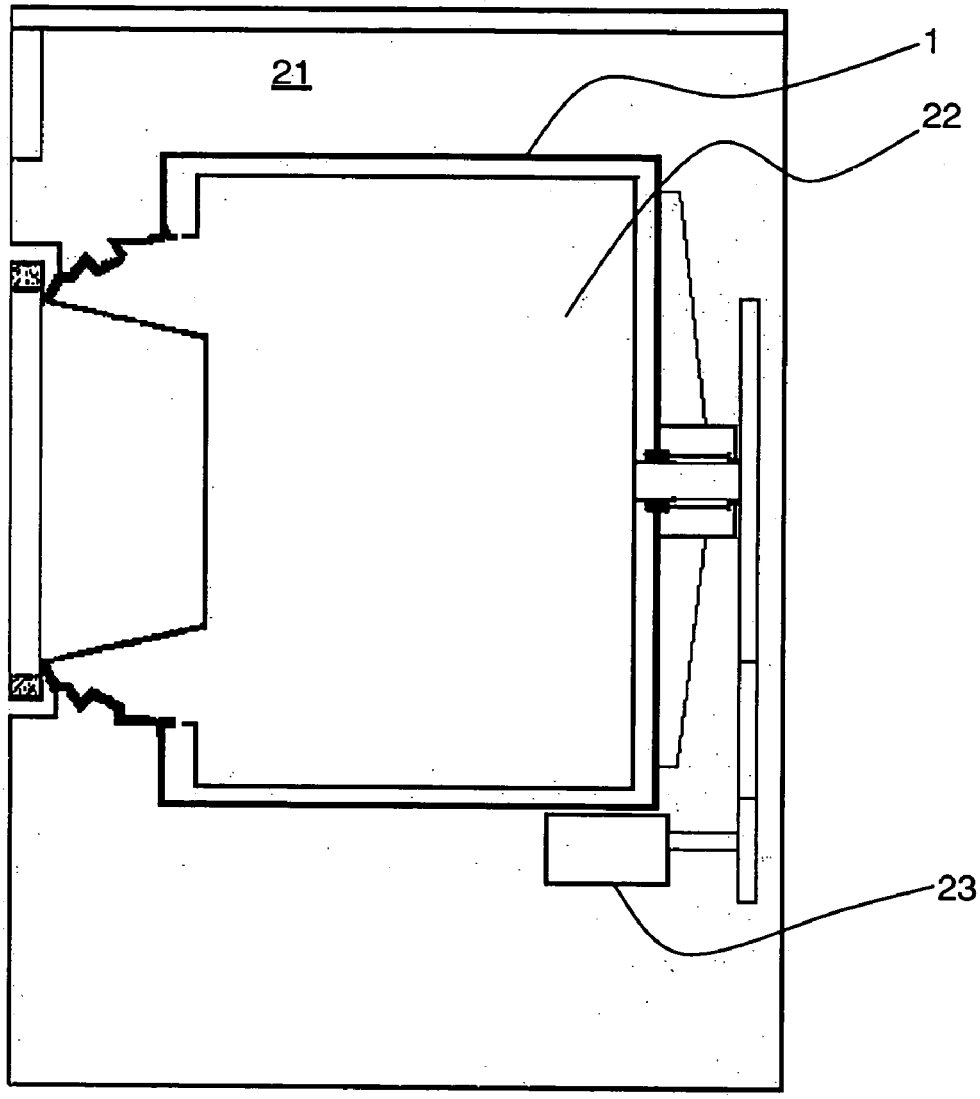
FIG. 7 a washing fluid tub arranged within a washing machine.

FIG. 7 schematically depicts a washing machine 21 provided with a washing fluid tub 1 with a drum 22 rotatably disposed therein. Aggregates 23, for instance the motor for rotating the drum 22, are disposed at the lower section of the washing fluid tub 1.

Figure 1:
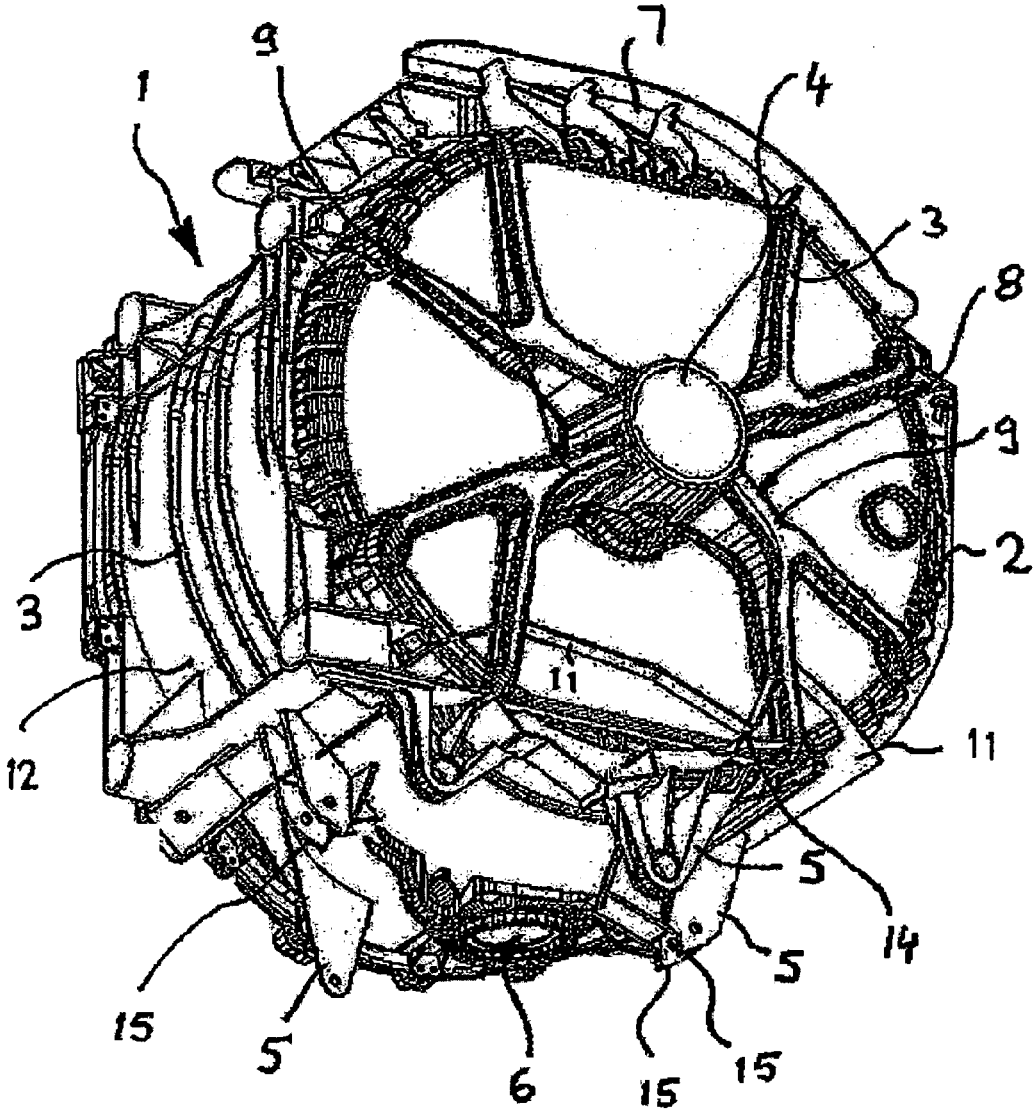
FIG. 1 is a perspective view of a washing fluid tub from the rear wall thereof.

FIG. 1 is a perspective view of a washing fluid tub 1 for a washing machine with a drum being mounted for rotation therein. The washing fluid tub 1 is preferably made of a synthetic material with rib structures 3 being integrally joined with the exterior wall 2 of the washing fluid tub 1. As may be seen in the rear wall view of the washing fluid tub 1 the rib structures 3 extend concentrically in the direction of a bearing sleeve 4 which serves to seat and bear the drive shaft (not shown in detail) of the drum rotatably mounted in the washing fluid tub 1. Brackets 5 are provided beneath the washing fluid tub 1 for supporting a motor (not shown in detail) for driving the drum.

In a lower portion of the cylindrical wall of the washing fluid tub 1 there is provided an opening 6 through which the washing fluid may be removed.

Figure 2:
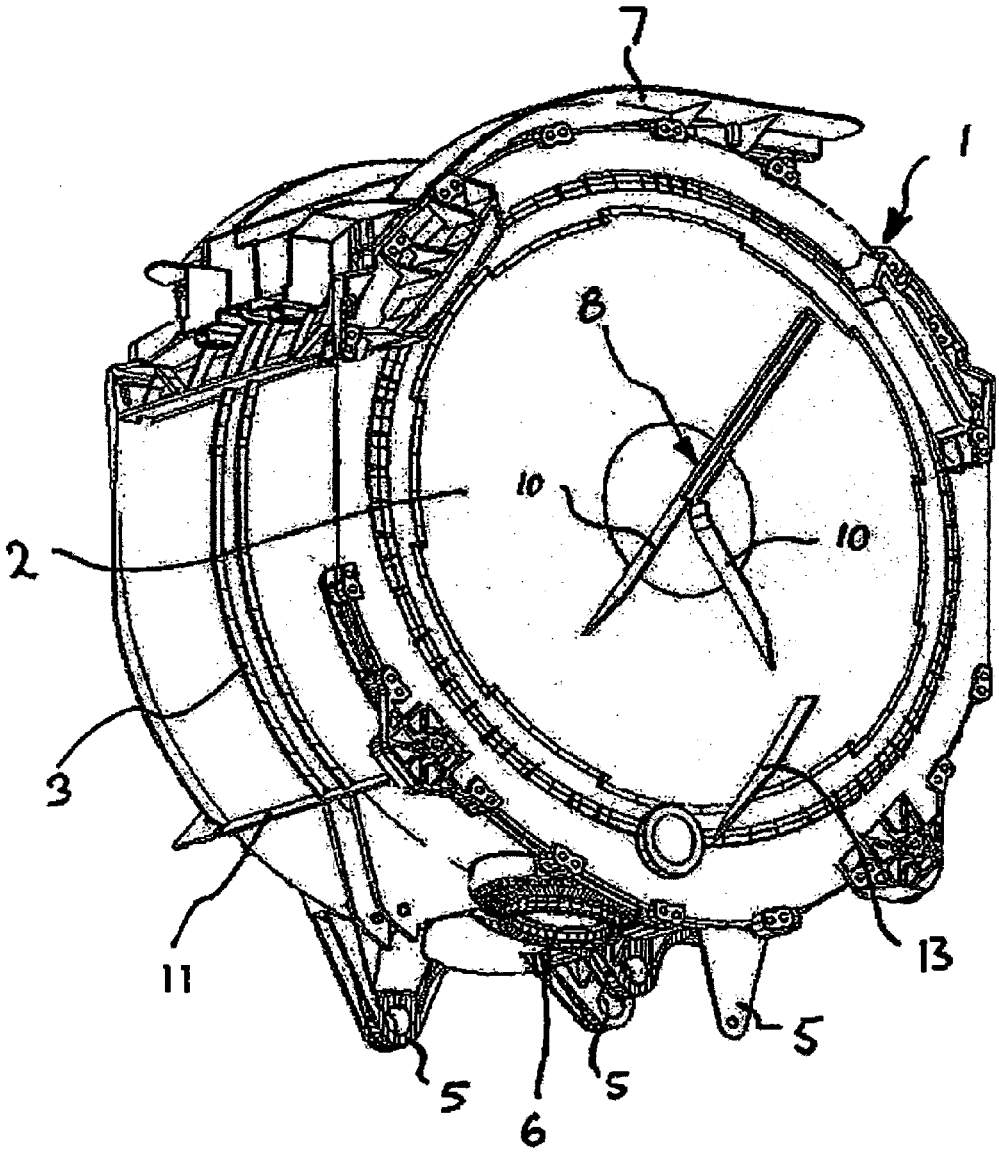
FIG. 2 is a further perspective view of the washing fluid tub from the front side thereof.

FIG. 2 depicts the washing fluid container 1 from its closed front side, with a closure device 7 being provided above the washing fluid tub 1 as is customary in top-loading machines. As may be seen from looking at FIGS. 1 and 2, water run-off ribs 8 are formed at the outer wall 2 of the tub 2 which on the one hand protect aggregates (not shown in any detail) cooperating with the tub 1 from leaking water and/or humidity and which on the other hand collect and divert the leaked water and humidity. For instance, ribs 9 are formed at the upper region of the outer wall of the tub 1 which affect an advance channeling of the water. The ribs 9 are shaped such that in the direction of flow they extend to a tip or convergent so that this advance channeling provides for an effective diversion. For instance, at the rear surface, FIG. 1, ribs 9 are connected in the manner of wings to the receiving sleeve 4 of the bearing, on both sides thereof, so that water occurring at the upper section is initially caught while the section below the receiving sleeve 4 remains free of any water. FIG. 2, which depicts the front side of the washing fluid tub 1, also depicts a wing-like arrangement of ribs 10 which point angularly away from the center and also maintain the lower section free of water.

As may be seen further from FIGS. 1 and 2, axially extending ribs 11 embracing the outer wall of tub 1 are integrally formed to the lower area of the tub 1 which serve to catch water in a controlled manner. Such a rib 11 may be seen in FIG. 1 in particular with the shape of the rib extending at the rear surface and on the surface of the cylindrical wall. A separate rib 13 is integrally formed with the front surface at the lower portion thereof which serves to catch water from the upper ribs 10 to divert it to the lower area of the washing fluid tub 1. As may be particularly seen in the perspective view of FIG. 1, defined drip-off sites 14 are formed into the embracing ribs 11 which affect a controlled diversion of the occurring water. It will be understood by those skilled in the art that additional drip-off ribs 15 are provided on the brackets 5 for the motor, dampeners or shock-absorbers for particularly critical sections at the exterior wall 2 of the tub 1.

Figure 3:
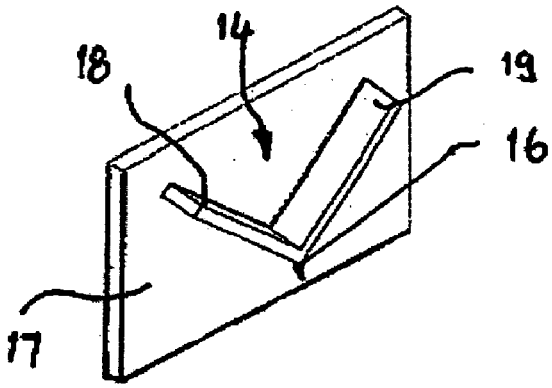
FIG. 3 is a detailed view of a defined drip-off site.
Figure 4:
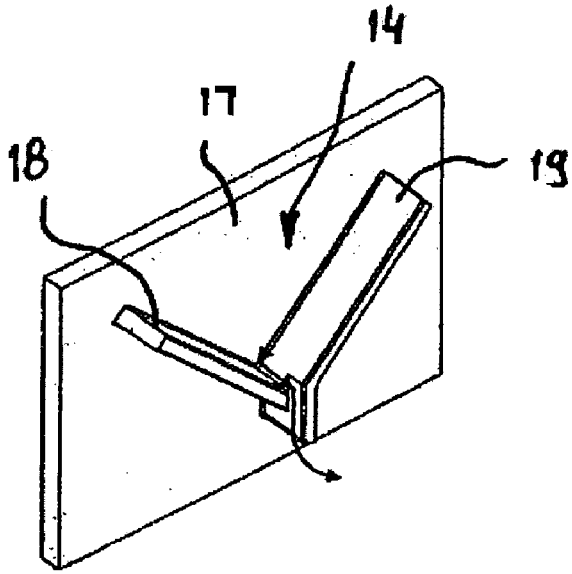
FIG. 4 is a further embodiment according to FIG. 3.
Figure 5:
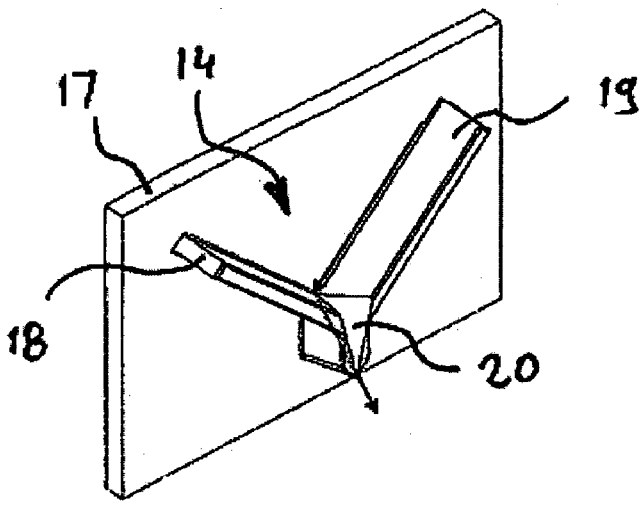
FIG. 5 is a further embodiment of a drip-off site according to FIG. 3.

The drip-off site 14 may be differently shapes as shown in FIGS. 3, 4 and 5. Thus, FIG. 3 depicts a defined drip-off site 14 which preferably is V-shaped. The perspective presentation of FIG. 3 reveals a drip-off nose 16 integrally formed below the V-shaped drip-off site 14. It will be apparent that if water occurs between the two branches of the V-shape it will collect at the deepest part thereof and that it will want to flow out of the V-shape. To prevent a return flow to the wall 17 of the tub, the collected water will be diverted by way of the drip-off nose 16 parallel to the wall of the tub 17, at some distance therefrom.

Another embodiment of a defined drip-off site 14 is also shown in perspective FIG. 4. The ribs 18 and 19 forming the V-shape are converging or are shaped such that a recess 21 is formed at the tip of the V-shape. However, the recess 21 extends over only part of the width of the ribs at their side opposite from the wall 17 of the tub. A lug is formed at one of the two ribs 18, 19, at rib 19, converging in the V-shape which extends beyond the deepest point of the drip-off site 14. As a consequence of the flow path thus formed is direction of flow is attained which extends parallel to the wall 17 of the tub at some spacing therefrom. The flow pattern of the water is also improved by the recess 21 at the tip of the converging ribs 18, 19 always directing the water to one of the vertically downwardly pointing ribs. A large radius at the lower edge of the lug the water, because of adhesion forces, experiences a large lateral component of movement, pointing from the lower edge parallel to the wall 12 of the tub as indicated by the flow arrows.

Figure 6:
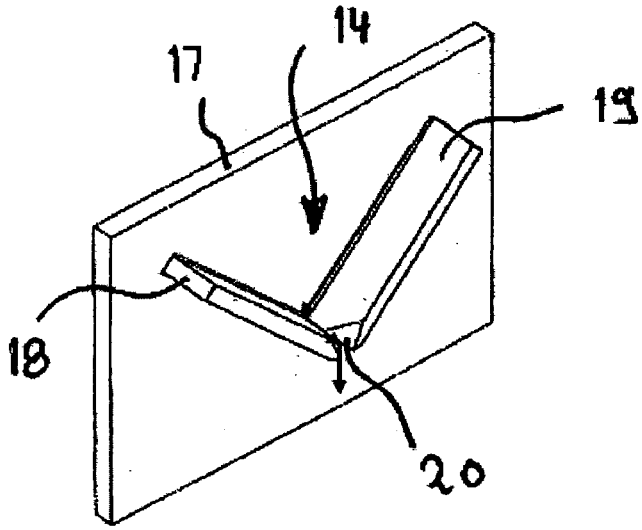
FIG. 6 is a further embodiment of a defined drip-off site according to FIG. 3.

A further variant of a drip-off site 14 in accordance with the invention is shown in FIGS. 5 and 6. FIG. 5 depicts a notch 20 opened in a forward direction at the tip of the ribs 18, 19 converging in a V-shape. The opening angle of the notch 20 results in a direction of flow of the water away from the wall 17 of the tub. The notch 20 is sunk in a lug below the intersecting line of the ribs 18, 19.

As a result of the forward-pointing notch, FIG. 5, the flowing-off water attains a stronger component of movement. The mass inertia of the water results in the water dripping or running off in a forward direction. Moreover, because of the pointedly converging notch 20 the water is progressively further separated from the ribs 18, 19 since the contact surfaces become increasingly smaller.

The adhesion force causes drops of water initially to be retained in the forward notch 20, FIG. 6, until further water causes drops to fall off in a vertical direction. In this manner, the tendency of the water under the ribs 18, 19 to flow to the area to be protected is effectively counteracted.

What is claimed is:

1. A washing liquid tub for a washing machine provided with electrical components, the tub being adapted to receive a rotatably movable washing drum, comprising:

a plurality of first rib structures formed on an outer surface of the tub for imparting structural rigidity to the tub;

a plurality of second rib structures formed on the outer surface of the tub for protecting the electrical components from precipitated water and for collecting and diverting the water; and a plurality of third rib structures formed in a upper section of the outer wall of the tub for providing advance channeling of the water.

2. The tub of claim 1, further comprising fourth rib structures stretching across at least part of the circumferential surface of the drum in a lower portion thereof.

3. The tub of claim 2, wherein at least one of the fourth rib structures is provided with at least one drip-off site.

4. The tub of claim 3, wherein at least one additional drip-off site is provided at particularly critical sections of the outer wall of the tub.

5. The tub of claim 2, wherein the drip-off site comprises a pair of ribs converging in a downward-pointing substantially V-shape configuration.

6. The tub of claim 5, wherein means is provided at the tip of the V-shaped configuration for controlling the direction of water flow.

7. The tub of claim 6, wherein the means comprises an extension of the tip of the V-shaped configuration.

8. The tub of claim 6, wherein the means is a recess formed between the pair of ribs at the tip of the V-shaped configuration.

9. The tub of claim 6, wherein at the tip of the V-shaped configuration at least one of the ribs of the pair is provided with a downward-pointing lug.

10. The tub of claim 9, wherein the lug comprises a downward-facing curved edge of large radius.

11. The tub of claim 6, wherein the means comprises a notch between the pair of ribs at the tip of there V-shaped configuration.

12. The tub of claim 11, wherein a lug is provided below the tip of the V-shaped configuration and the notch is provided within the lug.

* * * * *